US005148775A

United States Patent [19]

Peet

[11] Patent Number: 5,148,775

[45] Date of Patent: Sep. 22, 1992

[54] FEEDWATER CONTROL FOR DRUM TYPE STEAM GENERATORS

[75] Inventor: William J. Peet, Cambridge, Canada

[73] Assignee: The Babcock & Wilcox Company, New Orleans, La.

[21] Appl. No.: 823,503

[22] Filed: Jan. 22, 1992

[51] Int. Cl.[5] ..... F22D 5/26

[52] U.S. Cl. ..... 122/451 R

[58] Field of Search ..... 122/451 R, 451 S, 448.1; 137/11

[56] References Cited

U.S. PATENT DOCUMENTS 3,417,737 12/1968 Shinskey et al. ..... 122/448.1

4,242,989 1/1981 Chamberlain ..... 122/451 R 4,619,224 10/1986 Takita et al. ..... 122/451 R

*Primary Examiner*—Edward G. Favors

*Attorney, Agent, or Firm*—Vytas R. Matas; Robert J. Edwards

[57] ABSTRACT

An improved feedwater control for drum type steam generators is provided in order to gain improved drum level control for drum type steam generators which are subjected to great load changes at high rates of change. The control system accounts for changes in the mass inventory within the circulation lop by monitoring and adjusting to changes in steam flow and drum pressure. Thus, during load changes, the drum level will remain constant.

4 Claims, 3 Drawing Sheets

FEEDWATER CONTROL FOR DRUM TYPE STEAM GENERATORS

FIELD AND BACKGROUND OF THE INVENTION

The present invention relates in general to an improved feedwater control system for drum type steam generators, and in particular to a new and useful method and apparatus for providing improved drum level control to units which are subjected to great load changes at high rates of change.

The current feedwater control systems for drum type steam generators include the popular three-element feedwater control system which is a cascade-feedforward control loop which maintains water flow input equal to feedwater demand. The system employs feedback of the difference between the desired level as indicated by the set point and the actual level to compensate for any system errors such as transmitter drift, flow measurement errors etc.

A typical prior art feedwater control system is illustrated in FIG. 1.

A feedwater control valve 180 controls the sending of feedwater 200 to a drum type steam generator through three separate controls, namely a drum level transmitter 110, a steam flow transmitter 120, and a feedwater flow transmitter 140.

The drum level transmitter 110 sends a drum level signal 112 to a difference unit 116 wherein the difference between the drum level signal 112 and a drum level set point 105, originating from an analog control 170 is formed. The difference resulting from the comparison of the drum level signal 112 and the drum level set point 105 is the drum level error 108.

A drum level indicator 114 displays the value of the drum level signal 112 sent by the drum level transmitter 110.

The transmitter 120 sends a differential pressure signal 121 to a square root unit 122 for taking the square root of the signal 121 to determine the steam flow value 123.

A steam flow indicator 124 displays the steam flow value 123 after execution of the square root function by the square root unit 122.

The steam flow value 123 is then sent to a summation unit 128 which is a proportion controller which performs a summing function of the drum level error 108 and the steam flow value 123 in order to determine a summation value 130.

The differential pressure transmitter 140 sends a pressure signal 141 to a feedwater flow square root unit 142 which performs a square root function on the signal 141. A feedwater flow indicator 144 displays the feedwater flow signal 143.

The feedwater flow value 143 is sent to a signal lag unit 148 which delays the sending of the feedwater flow value 143 for a period of time determined by the function f(t) resulting in the signal lag value 150.

A PI controller 160 serves as a proportional action-plus integral controller for the deviation between the output of the summer unit 128 and the output of the signal lag unit 148 (where $\Delta$ is the deviation, K is proportion and $\int$ is the integral) and determines the output value 165 of the PI controller.

Once determined, the PI value 165 is then sent to the hand/auto station 170 which serves as the automatic control station with bias for the system. The station control 170, based on the PI value 165, will automatically control a feedwater control valve 180 which adjusts the amount of feedwater 200 sent to the drum type steam generator.

Although a three element feedwater control system can provide satisfactory feedwater control when the boiler is operated at steady loads through the use of the drum level set point 105 specified in FIG. 1, it is incapable of handling great load changes at high rates of change because there is not a way for the system to account for the change in mass inventory within the circulation loop. The circulation loop existing as the water and water/steam circulation system comprises the steam drum water space, the downcomers, the supplies, the furnace water walls, the boiler bank and mud drum, risers and the water/steam annulus in the steam drum.

The current state of the art in feedwater control systems can only react to a change in mass inventory once the drum level diverges from the set point. Thus, during a load change, the drum level cannot be maintained.

SUMMARY OF THE INVENTION

The present invention comprises a method and apparatus for an improved feedwater control for drum type steam generators by incorporating changes in mass inventory within the circulation loop enabling the system to control great load changes at high rates of change.

In order to control great load changes, the control system maintains a constant drum level before and after the load change such that the difference between the steam flow from the drum and the feedwater flow to the drum accounts for the change in the mass inventory within the circulation loop by a load and pressure change. The circulation loop includes, for example, the water and water/steam circulation system comprising the steam drum water space, the downcomers, the supplies, the furnace water walls, the boiler bank and mud drum, risers, and the water/steam annulus in the steam drum.

The changes in mass inventory within the circulation loop are incorporated into the feedwater control system by the present invention based on the relationships listed later in this disclosure.

An object of the present invention is, thus, to provide a feedwater control system that adjusts for differences in mass inventory before drum level changes are experienced because a mechanism is provided to incorporate changes in mass.

A further object of the invention is to provide a feedwater control system that automatically adjusts to varying rates of change for load and pressure.

A further object of the invention is to provide a feedwater control system that operates automatically without relying upon fixed feedwater demands for a timed period before releasing back to normal control.

A further object of the invention is to provide a feedwater control system that accounts for differences in boiler characteristics found in various boiler designs, namely mass inventory versus load or pressure because the invention relies upon the differential of the equation specific for each individual boiler type.

A further object of the invention is to provide a feedwater control system that accounts for all factors which affect drum level outside of factors attributable to drum shrink and swell from sever drum water sub-cooling or lack thereof.

A further object of the invention is to provide a feedwater control system that accounts for both step changes and ramp changes in load or pressure.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
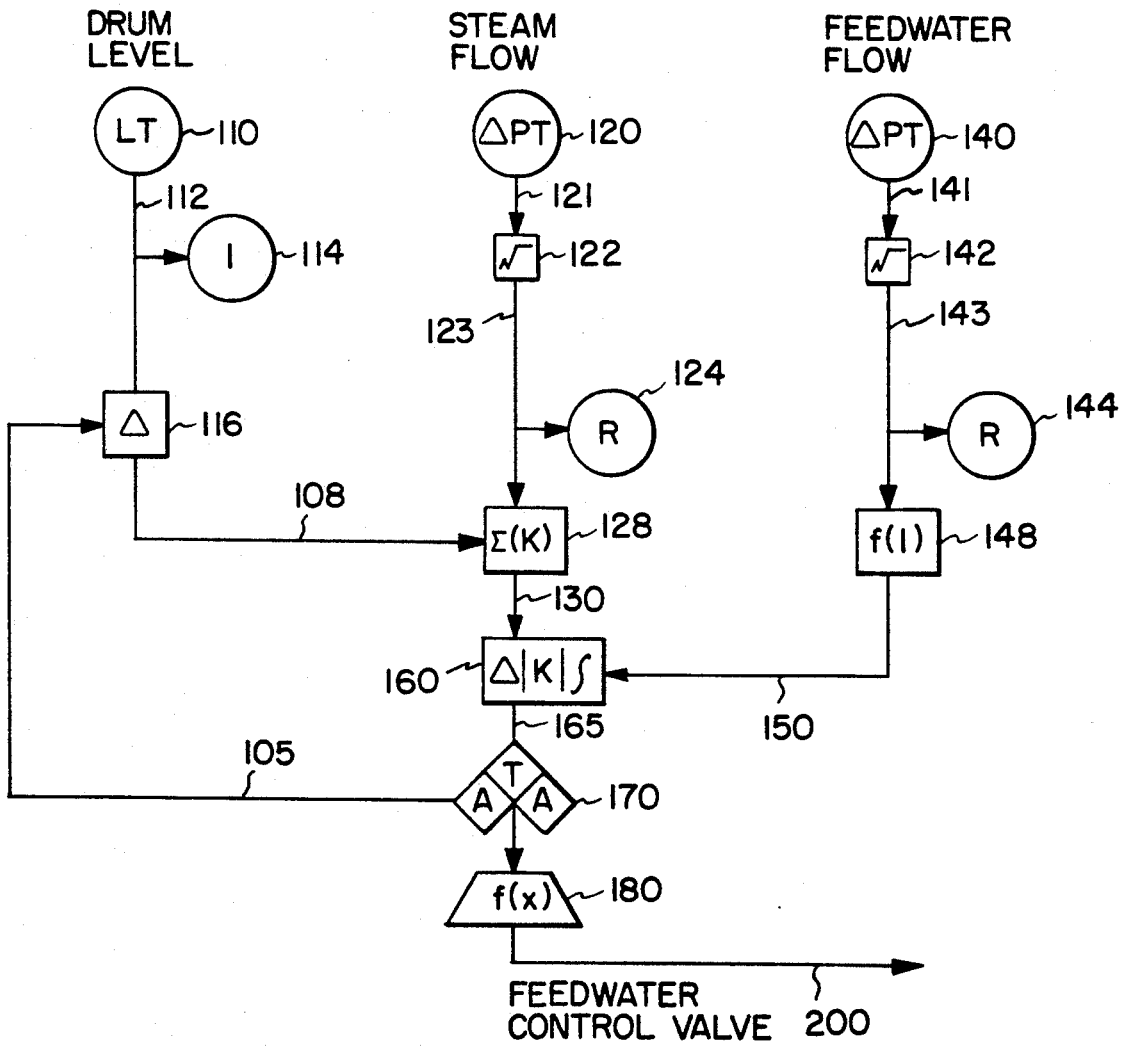
FIG. 1 is a schematic drawing of the prior art for a three element control with remote set point for a drum type steam generator.
Figure 2:
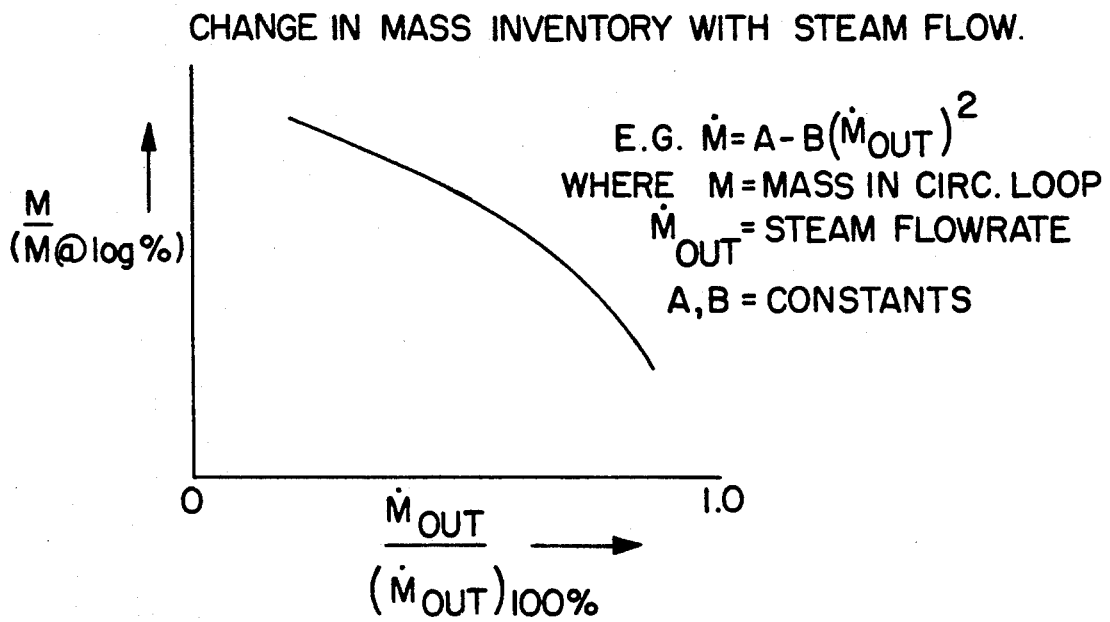
FIG. 2 is a graph plotting the change in mass inventory with steam flow according to the present invention.
Figure 3:
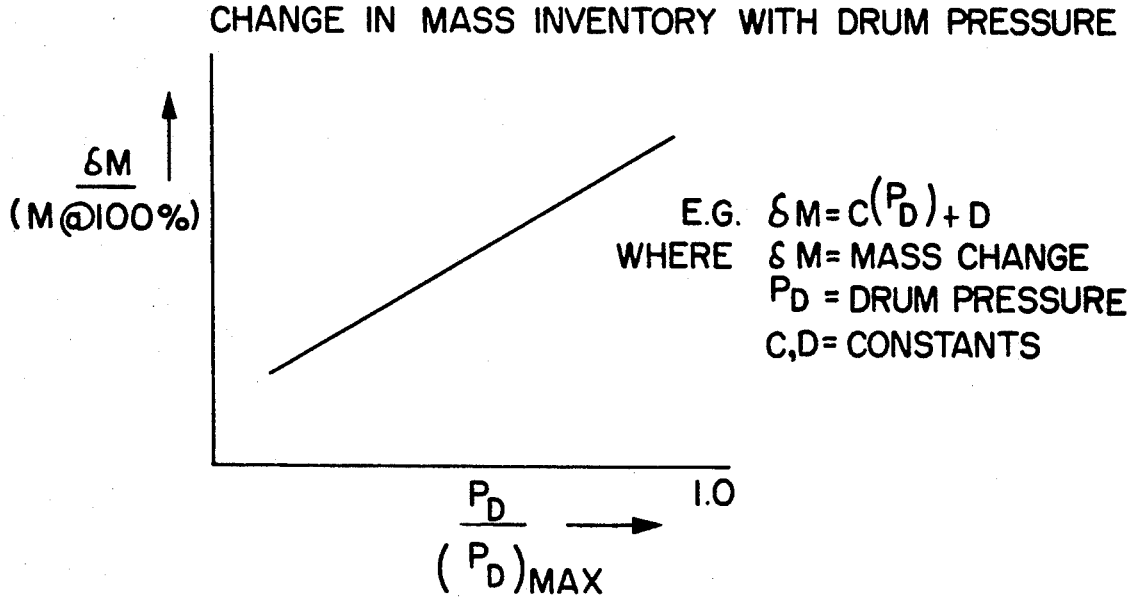
FIG. 3 is a graph plotting the change in mass inventory with drum pressure according to the present invention.

The variation in the total mass within a circulation loop for a constant drum level can be determined for changes in steam flow and changes in pressure. FIGS. 2 and 3 are graphical representations of necessary unit circulation characteristics for boilers in general.

The total mass inventory in the circulation loop versus the unit load is calculated on the basis of the normal operating mode, i.e., constant pressure or sliding pressure operation. FIG. 2 is a graphical illustration of the change in mass inventory with steam flow utilizing the formula $M=A-B(\dot{m}_{out})^2$ where $M$=mass in circulation loop;

$\dot{m}_{out}$=steam flow rate from drum; and $A,B$=constants.

The mass inventory versus drum pressure is calculated based on pressure variations from the normal. FIG. 3 is a graphical illustration of the change in mass inventory with drum pressure utilizing the formula $\delta M=C(P_d)+D$ where $\delta M$=mass change increment due to pressure;

$P_d$=drum pressure; and $C,D$=constants.

As a result, the following relationships would be known:

$$M=f(\dot{m}_{out}) \quad (1)$$

$$\delta M=f(P_d) \quad (2)$$

The rate of change of inventory would be given by:

$$d/dt\,(M)\ \&\ d/dt\,(\delta M)$$

The difference in the rate of flow in and out of the drum should equal the rate of change of mass in the circulation loop—i.e.,:

$$d/dt(M)+d/dt(\delta M)=\dot{m}_{in}-\dot{m}_{out} \quad (3)$$

where $m_{in}$=Feedwater flow rate to the drum

Substituting for equations (1) and (2) gives:

$$d/dt(f(\dot{m}_{out})+d/dt(f(P_d))=\dot{m}_{in}-\dot{m}_{out} \quad (4)$$

Using the substitution:

$$d/dt = (d/d\dot{m}_{out})\,(d\dot{m}_{out}/dt) \text{ and } d/dt = (d/dP_d)\,(dP_d/dt) \text{ gives} \quad (5)$$

$$\{d/d\dot{m}_{out}(f(\dot{m}_{out}))\}d/dt(\dot{m}_{out}) + \{d/dP_d(f(P_d))\}d/dt(P_d) = \dot{m}_{in} - \dot{m}_{out}$$

Since the functional relationship per equations (1) and (2) are known for any type of boiler, the differentials $d/dm_{out}(f(\dot{m}_{out}))$ and $d/dP_d(f(P_d))$ can be determined and will be depend on the degree of the polymonial represented by equations (1) and (2).

Thus, a relationship is developed, equation (5), which determines the difference in feedwater flow and steam flow required to maintain a constant drum level, for any rate of change of load $(d/dt(\dot{m}_{out}))$ and pressure $(d/dt(P_d))$.

Figure 4:
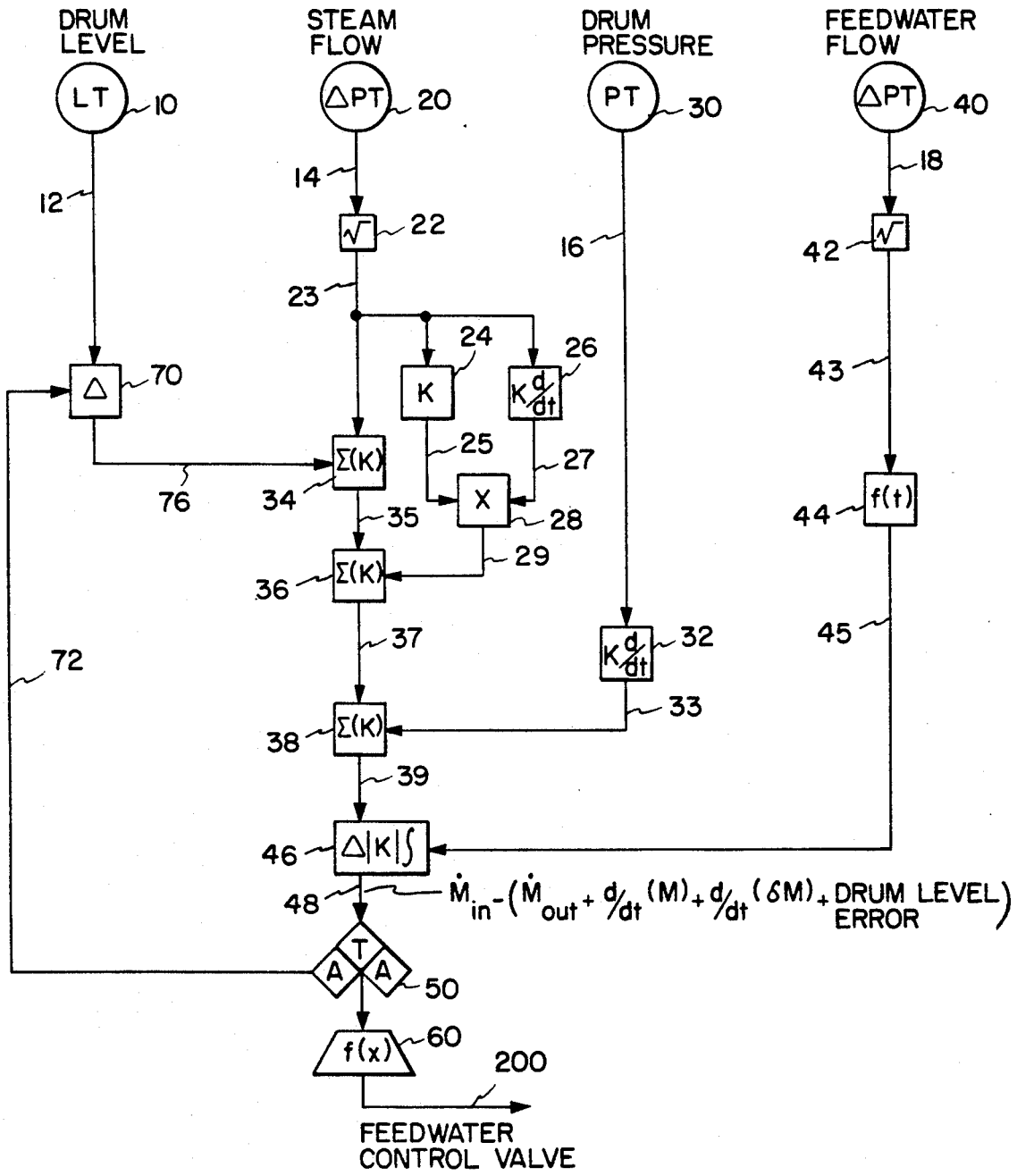
FIG. 4 is a block diagram of the present invention.

Referring now to the invention embodied in FIG. 4, an improved feedwater control for drum type steam generators having a four element control comprises a drum level transmitter 10, a differential pressure transmitter 20 for steam flow, a drum pressure transmitter 30 and a differential pressure transmitter 40 for feedwater flows. The invention also employs a drum level set point 72 generated by a hand/auto-station 50.

The drum level transmitter 10 sends the drum level signal 12 to a difference unit 70 which determines deviations between the drum level signal 12 and the drum level set point 72 set by the station 50. The resulting deviation measured by the difference unit 70 is the drum level error 76.

The differential pressure transmitter 20 sends a flow signal 14 to a square root unit 22 which performs a square root function in order to determine the steam flow value 23. The steam flow value 23 is sent to three separate units.

The steam flow value 23 is sent to a first summer or summation unit 34 which determines the proportional action of the steam flow value 23 in conjunction with the drum level error 76 taken from the difference unit 70. The sum of the proportional action of the steam flow value 23 and the drum level error 76 is the first summer value 35.

Additionally, the steam flow value 23 is sent to a proportional controller 24 which performs a proportionally function to the steam flow value 23 resulting in a proportional value 25.

Also, the steam flow value 23 is sent to a steam flow derivative action rate unit 26 which determines the derivative action rate value 27 by performing a derivative action rate function on the steam flow value 23.

Both the proportional value 25 and the derivative action rate value 27 are taken by the multiplier 28 which performs a multiplication function to determine the mass rate 29 of steam flow within the system identified as $d/dt(M)$, where $M=f(\dot{m}_{out})$.

The mass rate of 29 of the steam flow is sent to a second summer 36 along with the first summer value 35 in order to determine the sum of proportional action of the mass rate 29 and the first summer value 35. The resulting calculation after the summing function is performed, is a second summer value 37.

The drum pressure transmitter 30 transmits a drum pressure signal 16 to a drum pressure derivative action rate unit 32 which determines the mass flow increment 33 and is identified by the formula d/dt(δM), where $\delta M = f(P_d)$.

The mass increment 33 is sent to a third summer 38 where a summation function is performed on the mass increment 33 in conjunction with the second summer value 37. The resulting summation of proportional action determined by the third summer 38 is a third summer value 39.

The differential pressure transmitter 40 transmits a signal 18 to a feedwater flow square root unit 42 which performs a square function on the pressure signal 18 resulting in a feedwater flow value 43.

The feedwater value is then sent to a signal lag unit 44 which determines the signal lag value 45 by using the value 43 as a function of the time identified as f(t).

The signal lag value 45 and the third summer value 39 are sent to the PI (proportional integral) 46 identified as $\Delta''K|\int$, where Δ=deviation between the signal 39 and signal 45;

K=proportional action

∫=integral action.

The PI 46 performs a proportional plus-integral action upon the deviation signal in order to determine the PI value 48. The PI value 48 is defined by the formula $\dot{m}_{in} - (\dot{m}_{out} + d/dt(M) + d/dt(\delta M) +$ drum level error 76).

d/dt(M)+d/dt (δM)=rate of change of the total mass inventory in the circulation loop while the drum level error 76=deviation of drum level signal 12 from drum level set point 72.

The PI value 48 is taken by the hand/auto station 50 which provides automatic control with bias for the system and is used to control the feedwater control valve 60 which has the final controlling function for the system and regulates the feedwater 200 for the system.

While specific embodiments of the invention have been shown and described in detail to illustrate the application of the principles of the invention, it will be understood that the invention may be embodied otherwise without departing from such principles.

What is claimed is:

1. An apparatus for improving feedwater control to a drum type steam generator which undergoes load changes, comprising:

analog control means for setting a drum level set point;

drum level measuring means for measuring an actual drum level for the steam generator;

differential means connected to the analog control means and to the drum level measuring means for determining a drum level error value as a difference between the drum level set point and the actual drum level;

steam mass flow rate means for determining a steam mass flow rate for steam from the steam generator;

mass increment means for determining a rate of mass increment for the steam based on changes in steam flow;

mass increment means for determining a rate of mass increment for the steam generator based on changes in drum pressure;

feedwater flow measuring means for measuring actual feedwater flow to the steam generator;

summation means connected to the steam mass flow rate means and to the differential means for determining a proportional action sum of the drum level error value, the mass flow rate of steam and the rate of mass increment due to changes in steam flow and changes in drum pressure; and calculation means connected to the summation means and to the feedwater measuring means for calculating adjustments to the feedwater supply based on a proportional action sum of the drum level error, the mass flow rate of steam and the rate of mass increment due to changes in steam flow and drum pressure and feedwater flow, in order to maintain a constant drum level;

said calculation means being connected to the analog control means for supplying the adjustments to the analog control means for maintaining constant drum level while adjusting feedwater flow control to accommodate changes in load for the steam generator.

2. An apparatus according to claim 1, wherein the calculation means comprises square root means connected to the steam mass flow rate means for taking a square root of the steam mass flow rate, the square root being supplied to the summation means, a proportional action controller and a differential action controller connected to the square root means for receiving the square root value, multiplication means connected to the proportional and differential action means for multiplying a proportional value by a differential value for the square root to form a mass rate value, second summation means connected to the multiplication means and to the first mentioned summation means for forming a second summation value which is supplied to the calculation means.

3. An apparatus according to claim 2, including differential drum pressure action means connected to the drum pressure mass increment means for taking a mass increment due to change in drum pressure, and third summation means connected to the second summation means and to the drum pressure proportional action rate means, forming part of the calculation means for applying the adjustments to the analog control means.

4. A method of improving feedwater control for drum type steam generators which undergo load changes, comprising:

setting a drum level set point and controlling feedwater flow in a steam generator to maintain a selected drum level;

determining the difference between the drum level set point and an actual drum level to form a drum level error value;

determining a mass rate for the steam generator based on changes in steam flow;

determining a mass rate increment for the system based on changes in drum pressure;

calculating a proportional action sum of the drum level error, the mass rate of steam flow, the mass rate for the change in steam flow and the mass rate increment for change in drum pressure;

calculating adjustments in the system to account for the mass rate of steam flow, the mass rate for the change in steam flow, the mass rate increment for changes in drum pressure and feedwater flow in the system; and maintaining a constant drum level based on the calculated adjustments.

* * * * *